United States Patent [19]

Yamazaki

[11] Patent Number: 4,719,483

[45] Date of Patent: Jan. 12, 1988

[54] CONTROL STRIP SUPPLY APPARATUS

[75] Inventor: Seiichi Yamazaki, Kanagawa, Japan

[73] Assignee: Fuji Photo Film Co., Ltd., Kanagawa, Japan

[21] Appl. No.: 891,024

[22] Filed: Jul. 31, 1986

[30] Foreign Application Priority Data

Jul. 31, 1985 [JP] Japan ..... 60-117813[U]

[51] Int. Cl.[4] ..... G03D 3/13

[52] U.S. Cl. ..... 354/310; 354/321; 354/339

[58] Field of Search ..... 354/310, 311, 312, 313, 354/314, 316, 319, 320, 321, 338, 339, 298

[56] References Cited

U.S. PATENT DOCUMENTS

| | | | |
|---|---|---|---|
| 1,895,760 | 1/1933 | Hunt | 354/298 |
| 3,195,438 | 7/1965 | Woodcock | 354/310 |
| 3,636,851 | 1/1972 | Furst | 354/298 |
| 3,810,568 | 5/1974 | Kwiaikowski et al. | 354/310 |
| 4,067,034 | 1/1978 | Kwiaikowski | 354/319 |
| 4,218,123 | 8/1980 | Viehrig et al. | 354/310 |
| 4,311,379 | 1/1982 | Falomo | 354/319 |
| 4,363,548 | 12/1982 | Oberhoffner et al. | 354/310 |
| 4,406,534 | 9/1983 | Viehrig et al. | 354/310 |

*Primary Examiner*—A. A. Mathews

*Attorney, Agent, or Firm*—Sughrue, Mion, Zinn, Macpeak & Seas

[57] ABSTRACT

A control strip supply apparatus supplies a control strip for inspection of development conditions to a processing tank in a developing machine. The apparatus has a cassette accommodating the control strip, an inside cover of the developing machine on which the cassette is mounted, a guide block provided below the inside cover so as to guide the control strip drawn out of the cassette into the processing tank, and an outside cover which shields the path of the control strip from the cassette to the guide block. Accordingly, the control strip can readily and reliably be supplied into the processing tank while being shielded from light.

7 Claims, 2 Drawing Figures

CONTROL STRIP SUPPLY APPARATUS

BACKGROUND OF THE INVENTION

1. Field of the Invention

The present invention relates to a control strip supply apparatus for manually or automatically supplying a control strip to a developing machine which develops a photosensitive material.

2. Description of the Related Art

In general, a developing machine is supplied with a control strip which has been exposed at a predetermined density in advance for the purpose of inspecting the conditions of development effected by a developer in the developing machine.

In the case where a developing machine is connected to the downstream side of a printer which effects light exposure such as a printer processor, the above-described control strip is supplied from the printer to the developing machine so as to be fed into the developer.

However, some types of printer have no space for receiving a control strip, and some printer structures involve the problem that a control strip is caused to meander when being transported to the developing machine.

SUMMARY OF THE INVENTION

In view of the above-described circumstances, it is a primary object of the present invention to provide a control strip supply apparatus which enables a control strip to be readily and reliably be supplied to a developing machine from any position other than the associated printer.

To this end, the present invention provides a control strip supply apparatus comprising: mounting means for mounting a cassette accommodating a control strip at a predetermined position on a developing machine; guide means for guiding the control strip drawn out of the cassette into a processing tank in the developing machine; and cover means for shielding the path of the control strip from the cassette to the guide means.

Accordingly, in the present invention, a cassette which accommodates a control strip is mounted at a predetermined position on the developing machine by utilizing the mounting means, and the control strip is fed into the processing tank in the developing machine through the guide means, and then, the path of the control strip from the cassette to the guide means is shielded by the cover means. Thus, the control strip drawn out of the cassette is shielded from light and can reliably be fed into the processing tank.

To supply a control strip into the developing machine, it is only necessary to attach a leader to the leading end of the control strip and clamp this leader by guide rollers provided on the developing machine. The leader may be fed into the area between the guide rollers so as to be clamped thereby by a manual operation or by means of a driving force derived from, for example, a drive roller.

DESCRIPTION OF THE PREFERRED EMBODIMENT

Figure 1:
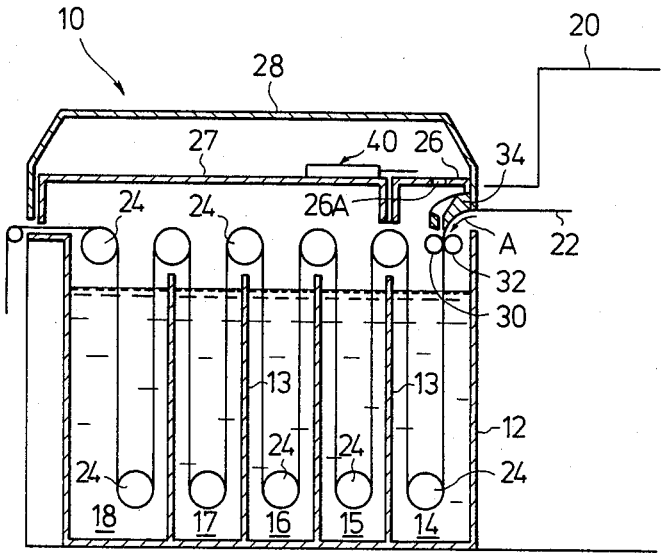
FIG. 1 is sectional view of a developing machine to which one embodiment of the present invention is applied.

FIG. 1 shows a developing machine 10 to which one embodiment of the present invention is applied. The developing machine 10 has a main body 12 the inside of which is divided by a plurality of partition walls 13 to provide processing tanks 14, 15, 16, 17 and 18 which respectively contain a developing solution, a bleaching solution, a fixing solution, washing water and a stabilizing solution for sequentially processing photographic paper 22 which has been subjected to light exposure in a printer 20. For this purpose, rollers 24 are respectively disposed at the lower end portion of each processing tank and at the upper side of each partition wall 13. These rollers 24 are rotated by means of the driving force from drive means (not shown) such as to guide the photographic paper 22 which is passed over them in such a manner that the photographic paper 22 is sequentially fed through the tanks 14 to 18.

Inside covers 26 and 27 are mounted above the main body 12 of the developing machine 10 for the purpose of preventing evaporation of the processing solutions in the processings tanks 14 to 18. Further, an outside cover 28 is mounted in such a manner as to cover the developing machine main body 12 from the outside of the covers 26 and 27, whereby the main body 12 is shielded from light. The outside cover 28 is connected to the main body 12 by hinge means such that the cover 28 can be opened and closed as desired.

The inside cover 26 covers the developing tank 14 so that the evaporated gas is prevented from reaching the other processing tanks, while the inside cover 27 covers all the other processing tanks 15 to 18.

A pair of guide rollers 30 and 32 are disposed above the developing tank 14 and rotated by means of the driving force from drive means (not shown) so as to feed the photographic paper 22 into the developing tank 14.

A guide block 34 (also shown in FIG. 2) which serves as guide means is secured to the developing machine main body 12 in such a manner as to extend above the guide rollers 30 and 32. This guide block 34 is provided with a curved guide surface 36 so that the photographic paper 22 which is fed out horizontally from the printer 20 is guided along the curved guide surface 36 in the direction of the arrow A and reliably fed to the area between the guide rollers 30 and 32.

The guide block 34 is further provided with a through-hole 38 which extends vertically so that a control strip 42 which is drawn out of a cassette 40 mounted on the inside cover 27 can be fed to the area between the guide rollers 30 and 32. For this purpose, the upper end portion of the through-hole 38 is gradually enlarged in width toward the upper side thereof, thereby providing curved guide surfaces 44 and 46. A through-hole 26A is formed in the inside cover 26 in order to pass the control strip 42.

The cassette 40 has a base plate 48 and a cover plate 50. The control strip 42 which has been subjected to light exposure in advance is clamped and thereby accommodated between the base and cover plate 48, 50. The cover plate 50 is pivotal relative to the base plate 48 as shown by the imaginary line in FIG. 2. Thus, after the control strip 42 has been mounted on the base plate 48, the cover plate 50 is closed as shown by the solid line in FIG. 2, whereby the control strip 42 is maintained in a light-shielded state.

A pair of projections 52 are provided on the undersurface of the base plate 48, the projections 52 being able to enter recesses 54, respectively, formed in the top surface of the inside cover 27. Thus, the pair of projections 52 and the pair of recesses 54 constitute in combination mounting means for mounting the cassette 40 at a predetermined position on the developing machine 10. This mounting means is adapted to be able to carry the counterforce generated when the control strip 42 is pulled toward the guide rollers 30 and 32. It should be noted that the projections 52 and the recesses 54 may be provided on the inside cover 27 and the base plate 48, respectively.

The mounting means having these structures are not necessarily limitative, and other mounting means may be employed. For example, the cassette 40 may be fastened to the inside cover 26 by a clip.

Figure 2:
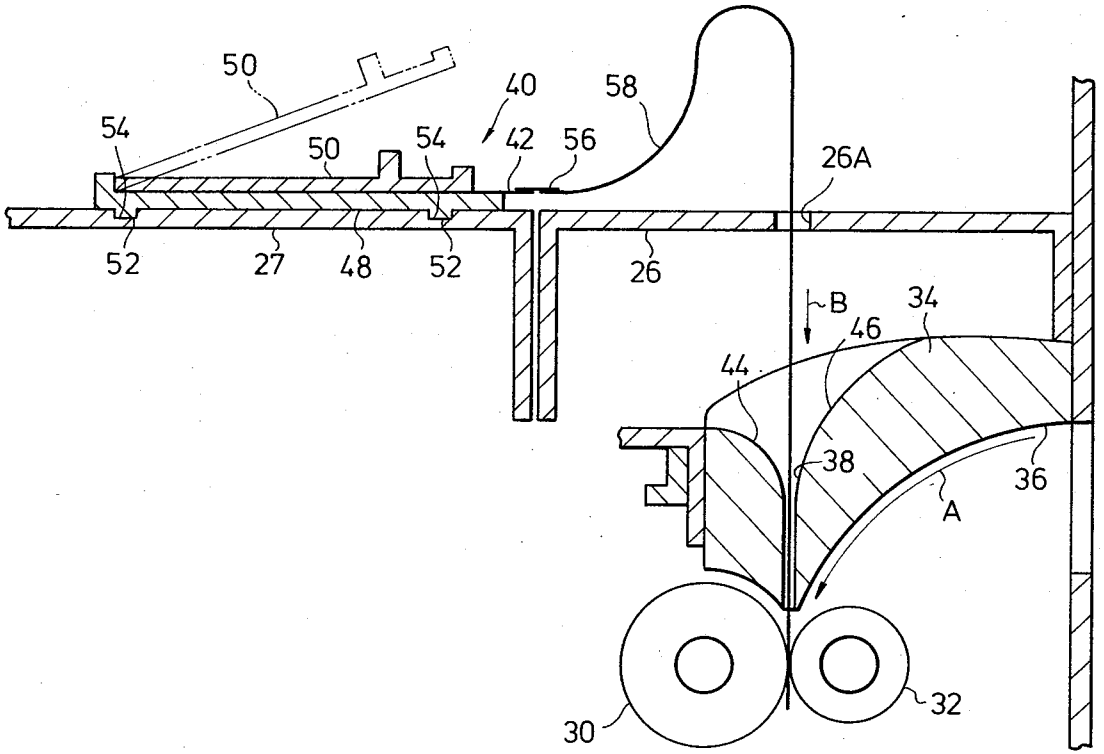
FIG. 2 is an enlarged sectional view of the inlet section in the developing machine shown in FIG. 1.

The control strip 42 is accommodated in the cassette 40 in such a manner that one end thereof projects from the cassette 40. A leader 58 is attached to the distal end of the projecting portion of the control strip 42 by a piece of adhesive tape 56. The leader 58 is made from a thin-walled synthetic resin sheet material and has such a length that the intermediate portion of the leader 58 can be bent as shown in FIG. 2 and, in this state, the distal, or leading, end portion of the leader 58 can be passed through the through-holes 26A and 38 and clamed between the guide rollers 30 and 32.

More specifically, when the leading end portion of the leader 58 is clamped between the guide rollers 30 and 32, the leader 58 is started to be pulled into the processing tank 14, and then, the outside cover 28 is closed. Therefore, the length of the leader 58 needs to be so set that there is no fear of the bend of the leader 58 being undesirably straightened to cause the control strip 42 to be drawn out of the cassette 40 before the cover 28 is closed.

The following is a description of the operation of this embodiment.

The control strip 42 is subjected to stepwise exposure using a predetermined wedge in advance and is then loaded into the cassette 40 in a darkroom state.

With the outside cover 28 of the developing machine 10 opened, the cassette 40 is mounted on the inside cover 27 using the combination of the projections 52 and the recesses 54.

One end of the leader 58 is attached to the distal end of the control strip 42 using a piece of adhesive tape 56. The leader 58 may be attached to the control strip 42 before the cassette 40 is mounted on the inside cover 27.

The leader 58 is bent at the intermediate portion thereof, and the leading end portion of the leader 58 is passed through the through-holes 26A and 38 and clamped between the guide rollers 30 and 32. In consequence, the leading end portion of the leader 58 is gradually fed into the processing tank 14 by the action of the guide rollers 30 and 32. As a result, the bend of the intermediate portion of the leader 58 is gradually straightened. Therefore, the cover 28 must be closed before the bend completely disappears and the leader 58 comes in contact with the curved guide surface 44.

When the bend of the intermediate portion of the leader 58 disappears after the cover 28 has been closed, the control strip 42 is pulled by the leader 58 and thereby drawn out of the cassette 40. Since the cover 28 has already been closed at this time, the path of the control strip 42 inside the cover 28 is shielded from light. Therefore, the control strip 42 which is drawn out of the cassette 40 is not accidentally exposed to light.

Accordingly, the control strip 42 is guided by the leader 58 in such a manner that the control strip 42 is pulled into the develping machine main body 12 and passed through each of the processing tanks 14 to 18 so as to be subjected to the development process before being taken out of the developing machine 10. In a developing machine of the type in which a rack is inserted into the developing tank, the inlet of the rack is provided with a guide having a structure which enables photosensitive materials to be fed in two directions so that a photosensitive material can be supplied into the developing tank from the outside of the developing machine, and a control strip can be supplied into the developing tank from the inside of the developing machine.

As has been described above, the present invention provides a control strip supply apparatus for supplying a control strip for inspection of development conditions to a developing tank in a developing machine, which comprises: mounting means for mounting a cassette accommodating the control strip at a predetermined position on the developing machine; guide means for guiding the control strip drawn out of the mounted cassette into the developing tank; and cover means for shielding the path of the control strip from the cassette to the guide means. Accordingly, even when the control strip cannot be supplied from the associated printer, it is possible to readily and reliably supply the control strip into the developing tank in the developing machine while maintaining the control strip in a light-shielded state.

What is claimed is:

1. In a developing machine for photographic paper having a plurality of processing tanks for processing the photographic paper, inside cover means enclosing the processing tanks, photographic paper driving means for feeding the paper sequentially through the processing tanks, and first aperture means disposed in the developing machine for permitting photographic paper to be introduced into the developing machine, the improvement comprising:

control strip supply means adapted to feed a control strip to the paper driving means to be sequentially fed through the processing tanks prior to the feeding of the photographic paper for inspection of development conditions in the developing machine, said control strip supply means including a cassette accommodating said control strip and mounting means for mounting said cassette on the inside cover means;

second aperture means disposed in the inside cover means for permitting said control strip to be introduced into the developing machine;

outside cover means mounted on said developing machine and overlying said control strip supply means to shield said supply means from light; and guide means disposed adjacent said first and second aperture means for guiding the control strip drawn out of said cassette to the paper driving means.

2. In a developing machine as recited in claim 1, said mounting means being defined by at least one projection provided on said cassette, and at least one corresponding recess provided in the inside cover means and engageable with said projection.

3. In a developing machine as recited in claim 1, wherein said cassette has a been plate and a cover plate, said cover plate being pivotal relative to said base plate.

4. In a developing machine as recited in claim 2, wherein said outside cover means is connected to said developing machine by a hinge so that the outside cover can be opened and closed as desired.

5. In a developing machine as recited in claim 1, wherein said guide means includes a guide block which is provided below said inside cover and which has a control strip-passing through-hole which is provided with first and second curved guide surfaces such that the width of the opening plane of said through-hole gradually decreases from an upper end thereof toward a lower side, thereby allowing said control strip to be smoothly supplied into said processing tank.

6. In a developing machine as recited in claim 5, wherein said guide block is further provided with a third curved guide surface which guides photographic paper introduced horizontally into said developing machine in such a manner that said photographic paper is moved along said third curved guide surface and directed toward said paper driving means of said processing tanks.

7. In a developing machine as recited in claim 6, wherein said paper driving means include a pair of guide rollers disposed below said guide block for feeding said control strip and said photographic paper into a processing solution contained in said processing tanks.

* * * * *